United States Patent [19]

Pflueger

[11] 4,402,508

[45] Sep. 6, 1983

[54] HANDLE TRIGGER GRIP

[76] Inventor: Donald C. Pflueger, 1366 Gross Ave., Charleston A.F.B., S.C. 29404

[21] Appl. No.: 327,917

[22] Filed: Dec. 7, 1981

[51] Int. Cl.[3] ..... A63B 49/00

[52] U.S. Cl. ..... 273/75; 273/73 J

[58] Field of Search ..... 273/73 J, 75, 67 DA, 273/67 DB, 81.4, 165, 81 C, 81 D, 81 R; 280/607, 609

[56] References Cited

U.S. PATENT DOCUMENTS 1,804,316 5/1931 Butler ..... 273/165

OTHER PUBLICATIONS

"Trigger", World Tennis, Mar. 1976.

*Primary Examiner*—Richard C. Pinkham
*Assistant Examiner*—Matthew Schneider
*Attorney, Agent, or Firm*—Larry Harold Kline

[57] ABSTRACT

A device is disclosed for attachment to a handle which is secured to a striking area and utilized by a person comprising a base, a trigger extension with a resting area for supporting the hand of the person utilizing the handle, and securing apparatus for securing the alignment of the trigger extension with respect to the handle.

5 Claims, 10 Drawing Figures

HANDLE TRIGGER GRIP

This invention relates to an improvement in a racquet handle and more particularly to a racquet handle which is designed to improve the gripping ability of the player of the racquet game.

The basic purpose of the handle and the grip on the handle is to control the racquet. Ideally, the grip should make the racquet feel like a natural extension of the arm. The grip of the handle is frequently changed for various strokes. The index or control finger of the hand may be held high on the racquet handle in order to increase control of the grip onto the handle of the racquet. The present invention improves the grip on the handle of the racquet.

An object of the present invention is to provide a trigger grip extending outward from the handle of a racquet upon which a portion of the hand of the player of the racquet game may rest.

Another object of the present invention is to provide a trigger grip which extends outwardly from the handle of a racquet which may be built into the handle of the racquet at the time the handle is manufactured.

Still another object of the present invention is to provide a trigger grip which extends outwardly from the handle of a racquet which may be built onto an insert which may be inserted into an indented area within the handle of a racquet.

A further object of the present invention is to provide a trigger grip which extends outwardly from the handle of a racquet which may be built onto an attachment which wraps around a portion of the handle of a racquet and may be secured thereon.

Another object of the present invention is to add a surface extending outward from the handle of a racquet on which a portion of the hand of the player of a racquet game may rest which increases the control of the racquet by the player.

Still another object of the present invention is to add a surface extending outward from the handle of a racquet on which a portion of the hand of a player of a racquet game may rest which decreases the possibility of slippage of the handle of the racquet from the player's hand.

A further object of the present invention is to provide an extension extending outward from the handle of a racquet which will absorb pressure of the grip of the hand on the racquet in order to save wear and tear on the grip covering of the handle of the racquet.

Another object of the present invention is to provide an extension of the handle of a racquet which can be utilized by players using either their right or left hand without changing the handle or the extension of the handle of the racquet.

These and other objects and features of the invention will be apparent from the following description and appended claims.

Briefly, the invention is a device for attachment to a handle secured to a striking area and utilized by a person. The device has a base sized and shaped to fit on the handle, a trigger extension, and securing means. The trigger extension has a resting area for supporting a portion of the hand of the person utilizing the handle. The trigger extension is secured to the base and extends outward from the base away from the handle. The securing means secures the base to the handle and, thereby, secures the alignment of the trigger extension with respect to the handle. The handle may be gripped securely utilizing the trigger extension in order to maximize the effectiveness of the movement of the handle to control the placement of the striking area.

The device may have a base that is constructed into and becomes a portion of the handle. The handle may be straight. The handle may be curved. The handle may have an indented portion and the base may fit within the indented portion. The indented portion of the handle may have a handle grooved surface. The bottom of the base may have a base grooved surface. The base grooved surface may fit into the handle grooved surface to provide a slip-resistant contact between the base and the handle.

The securing means may be grip wrapping which is wrapped around the handle and over the base to secure the base to the handle and secure the alignment of the trigger extension with respect to the handle.

The base may extend over the exterior surface of the handle. The interior surface of the base may fit over the exterior surface of the handle. The trigger extension may be curved. The trigger extension may be smooth. The resting area of the trigger extension may have a knurled surface.

The invention will be more fully understood from the following detailed description and appended claims when taken with the drawings in which:

FIG. 1 is an elevational view of a racquet 1 with a trigger grip 5 on the racquet handle 4.

FIG. 2 is a partial elevational view of a trigger grip 11 on a curved racquet handle 9.

FIG. 3 is a partial sectional exploded view of a racquet handle 4 with an indented, grooved portion 13 and a grooved, removable trigger insert 15, showing the wrapping 8 exploded from the racquet handle 4.

Figure 5:
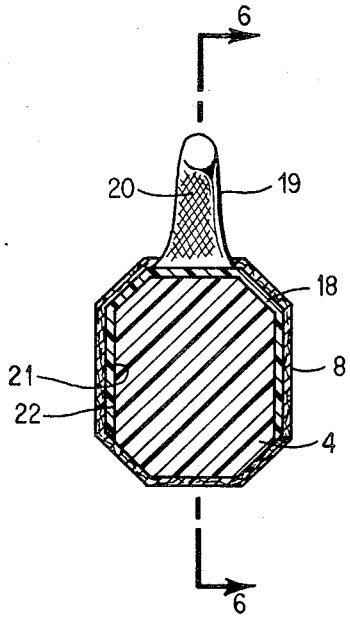
FIG. 5 is a lateral sectional view taken at section 5—5 of FIG. 4.
Figure 6:
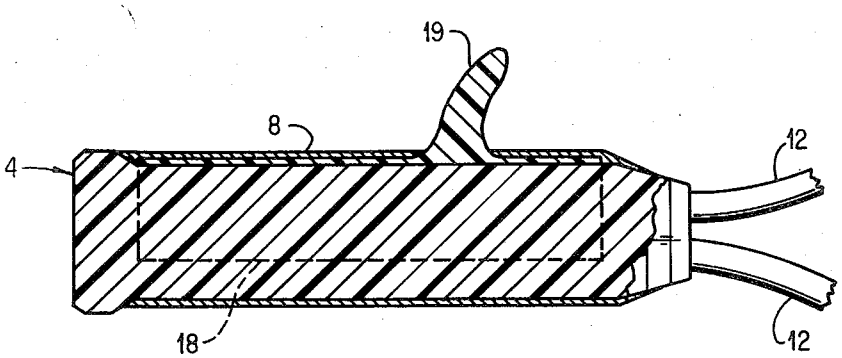

FIG. 6 is a longitudinal sectional view of racquet handle 4 with the wrap-around trigger attachment 18 secured thereon taken at section 6–6 of FIG. 5.

Figure 7:
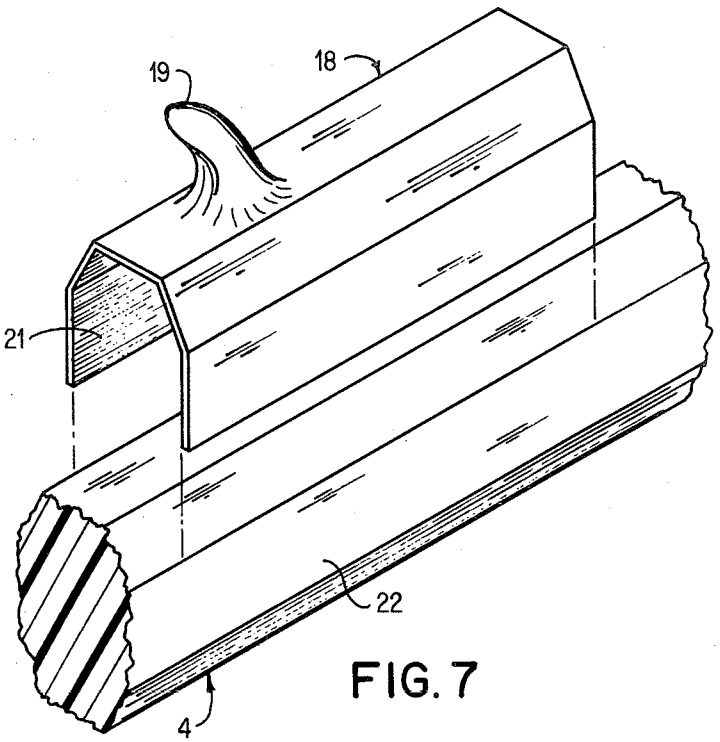

FIG. 7 is an exploded partial isometric view of wrap-around trigger attachment 18 exploded from racquet handle 4.

Figure 8:
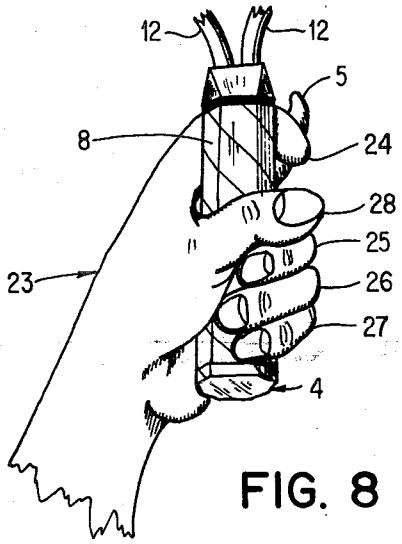

FIG. 8 is a partial elevational view of a racquet with racquet handle 4 with trigger grip 5 secured thereto, showing the racquet handle 4 being gripped by a left hand 23.

Figure 9:
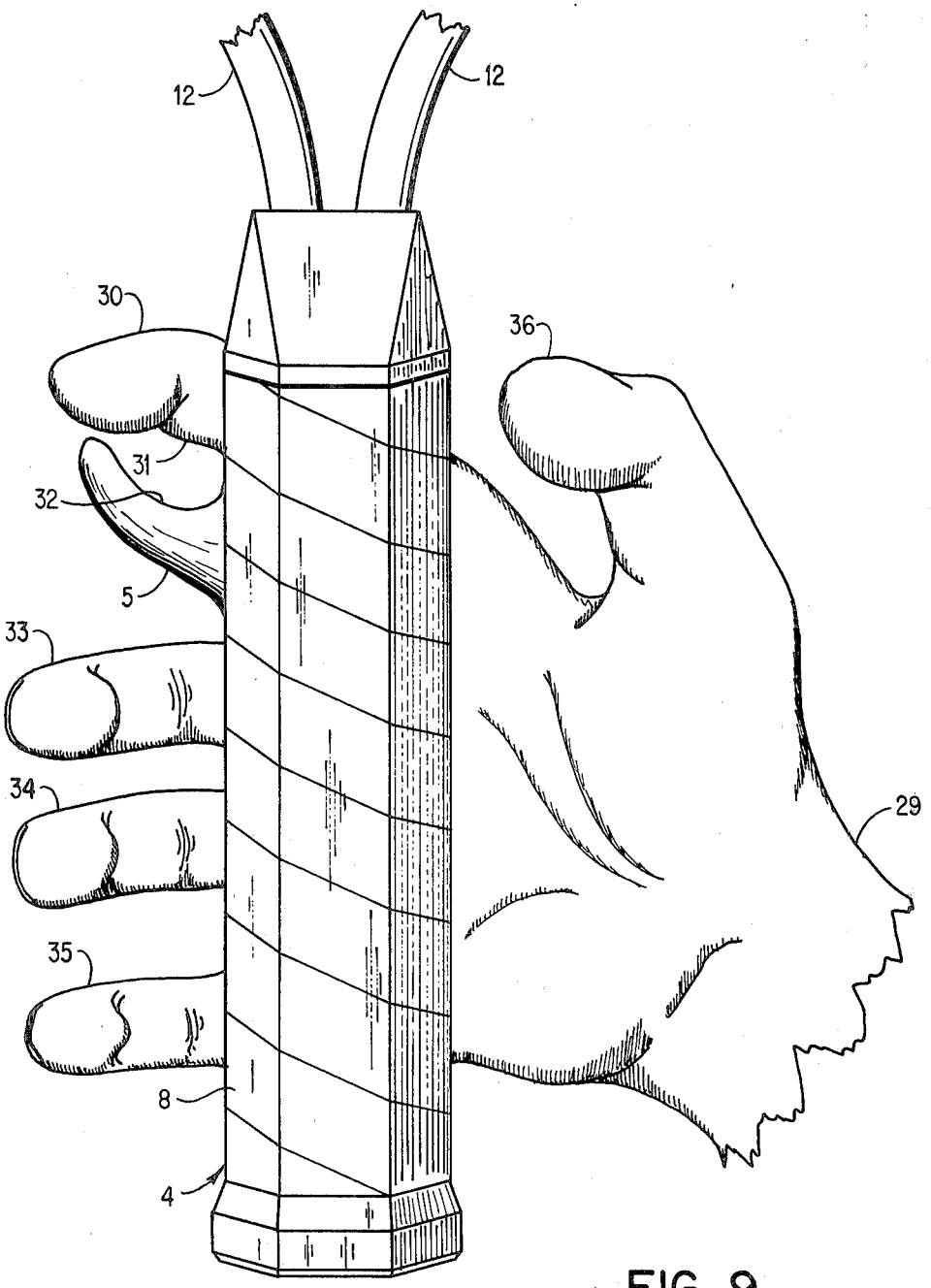

FIG. 9 is a partial elevational view of a racquet with a racquet handle 4 with a trigger grip 5 secured thereto, showing the racquet handle 4 about to be gripped by a right hand 29.

Figure 10:
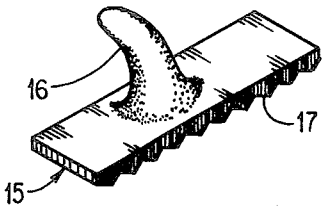
Figure 3:
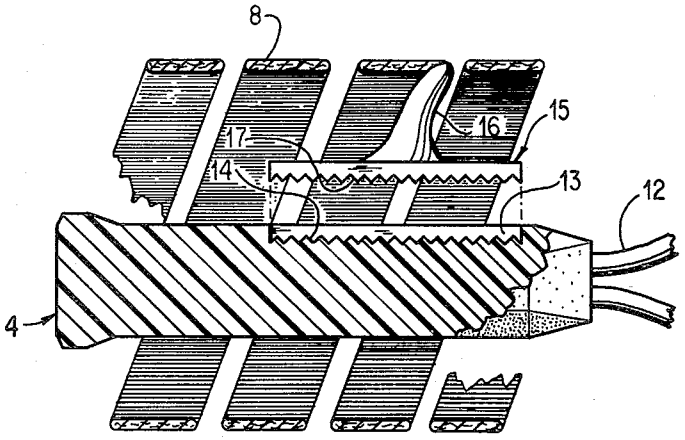

FIG. 10 is an isometric view of the removable trigger insert 15 shown in FIG. 3.

Figure 1:
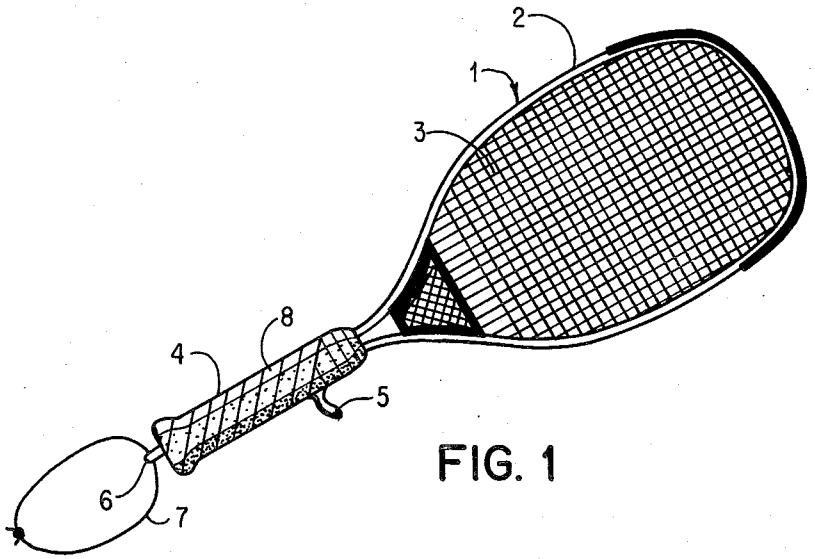

Referring now to the drawings, FIG. 1 is an elevational view of a racquet 1 with a trigger grip 5 on the racquet handle 4. The racquet 1 illustrated is a racquet ball racquet. However, the present invention may be utilized on any type of racquet, including tennis, ping pong, and squash racquets. The racquet 1 is shown having a racquet head 2 with a racquet face 3 and a racquet handle 4. The racquet face 3 comprises the string surface in the racquet illustrated, or the face surface of any other racquet desired.

On the racquet handle 4 is shown in extension 5 which may be called a trigger grip 5. In FIG. 1, a thong 7 is shown connected to a thong support 6 which is secured to the base of racquet handle 4. The thong 7 and the thong support 6 are only shown in FIG. 1 for illustrative purposes.

The racquet handle 4 has an outer wrapping 8. Trigger grip 5 extends outward from the racquet handle 4 and is not covered by the wrapping 8.

Figure 2:
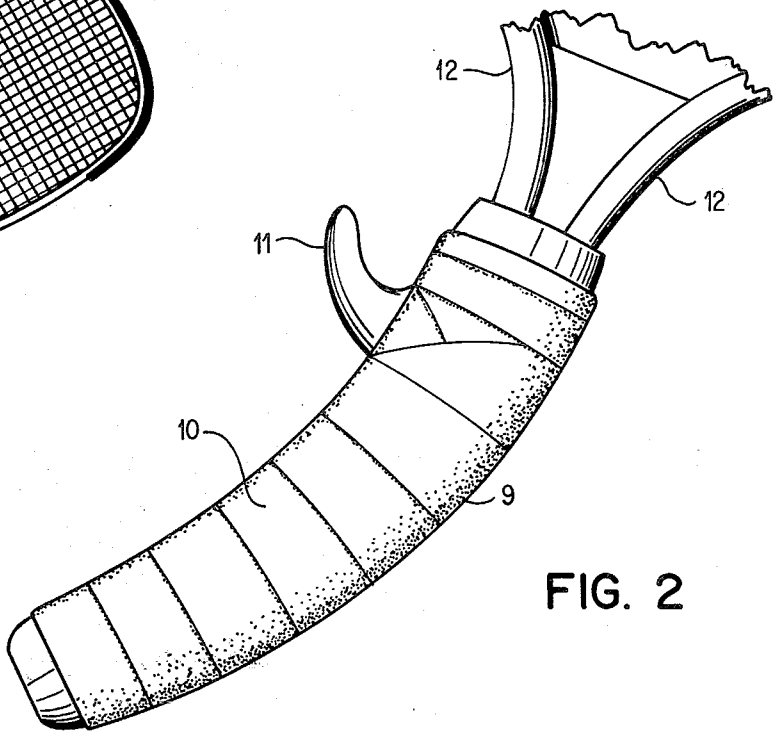

FIG. 2 is an elevational view of a trigger grip 11 secured onto a curved racquet handle 9. The curved racquet handle 9 has an outer wrapping 10 which is wrapped around the handle 9, but not over the trigger grip 11. The racquet head member 12 is shown partially and may be any racquet head member. The trigger grip 11 on curved racquet handle 9, and the trigger grip 5 on straight racquet handle 4 may be placed onto those handles in any manner desired. The trigger grip 5 may be built into the racquet handle at the time of manufacture or may be added onto the racquet handle, as desired, at a later time.

FIG. 3 is a partial sectional exploded view of a racquet handle 4 with an indented, grooved portion 13 and a grooved, removable trigger insert 15, showing the wrapping 8 exploded from the racquet handle 4. FIG. 3 illustrates one method of securing a removable trigger 16 onto a racquet handle 4. If for some reason the trigger 16 is damaged, the entire removable trigger insert 15 can be replaced without having to replace the entire racquet or racquet handle 4.

As seen in FIG. 10, the removable trigger insert 15 comprises a trigger 16 extending outward from a flat surface and grooves 17 on the bottom of the removable trigger insert 15. The grooves 17 may fit within grooves 14 which are within the indented portion 13 in the racquet handle 4. Wrapping 8 may be utilized to secure the removable trigger insert 15 onto the racquet handle 4. If the removable trigger insert 15 had damage to its trigger 16, the wrapping 8 may be removed and a new removable trigger insert 15 installed to replace the damaged removable trigger insert 15. Also, if a different angle or style extension were desired, the removable trigger insert 15 may be changed, as desired. The surface from which the trigger 16 extends may be flat or of any other desired shape.

Figure 4:
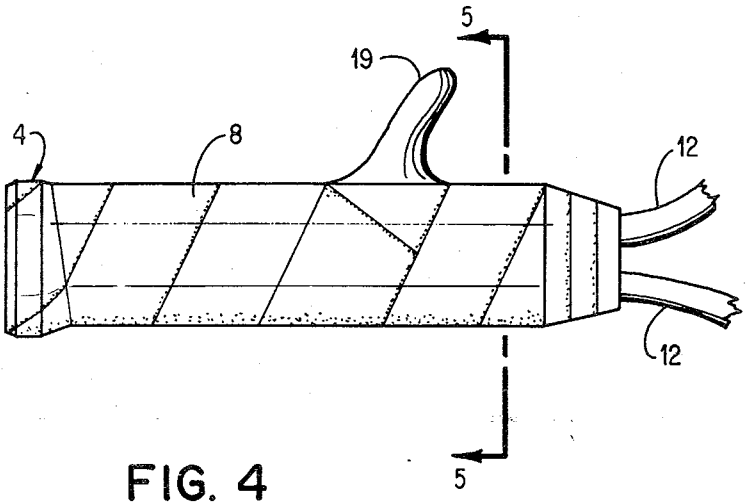
FIG. 4 is a partial elevational view of a racquet handle 5 with a trigger 19 secured thereon.

FIG. 4 is a partial elevational view of a racquet handle 5 with a trigger 19 secured thereon. The trigger 19 is on a wrap-around trigger attachment 18 which is shown in FIGS. 5, 6, and 7. The wrap-around trigger attachment 18 is secured onto racquet handle 4 by wrapping 8. Racquet head member 12 may be any desired racquet head.

FIG. 5 is a lateral sectional view taken at section 5—5 of FIG. 4. As shown, the interior surface of wrap-around trigger attachment 18 fits over the exterior surface of racquet handle 4. The wrap-around trigger attachment 18 may be designed to fit over any racquet handle and may extend as far around the racquet handle as desired. In FIG. 5, the trigger 19 is shown having a knurled inner surface 20 which may be optionally used for better gripping purposes, as desired by the user or manufacturer.

FIG. 6 is a longitudinal sectional view of racquet handle 4 with the wrap-around trigger attachment 18 secured thereon taken at section 6—6 of FIG. 5. As shown, the wrap-around trigger attachment 18 does not extend completely around the racquet handle 4, but extends far enough to become a stable base for the trigger 19 when the wrap-around trigger attachment 18 is secured onto racquet handle 4 by wrapping 8. Utilizing the wrap-around trigger attachment 18, the trigger extension 19 may be secured onto any present-day prior-art racquet handle.

The wrapping 8 on the racquet handle 4 may be removed, the wrap-around trigger attachment 18 may be placed thereon, and the wrapping 8 replaced onto the racquet handle 4 over the wrap-around trigger attachment 18. If the trigger 19 is ever damaged, or is desired to be removed, the reverse process can return the racquet handle 4 to the original condition, or a new wrap-around trigger attachment 18 may be placed thereon.

FIG. 7 is an exploded partial isometric view of wrap-around trigger attachment 18 exploded from racquet handle 4. The interior surface 21 of wrap-around trigger attachment 18 fits over the exterior surface 22 of racquet handle 4. The wrap-around trigger attachment 18 may be pre-formed to fit over a specifically-shaped racquet handle or may be constructed of a substance which conforms easily to whatever shape it is placed over.

FIG. 8 is a partial elevational view of a racquet with racquet handle 4 with trigger grip 5 secured thereto, showing the racquet handle 4 being gripped by a left hand 23. The left hand 23 has fingers 24, 25, 26, and 27, and a thumb 28. The index finger 24 is shown pressing against the trigger grip 5 which is secured onto racquet handle 4. The other fingers 25, 26, and 27, and the thumb 28 are placed around the racquet handle covering or wrapping 8. The racquet handle 4 is securely held by the left hand 23 with the pressure of the index finger 24 on the trigger grip 5 aiding the ability of the left hand 23 to control the movement of the racquet handle 4.

FIG. 9 is a partial elevational view of a racquet with a racquet handle 4 with a trigger grip 5 secured thereto, showing the racquet handle 4 about to be gripped by a right hand 29. The right hand 29 has fingers 30, 33, 34, 35, and a thumb 36. The right hand 29 is about to grip the racquet handle 4 in a manner that the index finger 30 would be pressed onto the trigger grip 5. The other fingers 33, 34, and 35, and the thumb 36 would be wrapped around the wrapping 8 around racquet handle 4. When the index finger 30 is placed onto the trigger grip 5, the lower and side surface 31 of finger 30 is pressed against the upper pressure surface 32 of trigger grip 5.

The trigger grip may be of any shape or size desired. The trigger grip may be completely smooth, may have a knurled surface as shown in FIG. 5, or may be of any texture desired.

The index finger 30 may totally press against upper pressure surface 32 of trigger grip 5 or may press against the upper pressure surface 32 and the portion of the wrapping 8 on racquet handle 4 just above the trigger 5. The fingers of the hand may be moved to alternate forehand or backhand or other desired gripping techniques utilizing the trigger grip 5 for better control.

FIG. 10 is an isometric view of the removable trigger insert 15 shown in FIG. 3. The removable trigger insert 15 may be designed in any shape desired, as long as the racquet handle has a compatible indented portion within which the removable trigger insert 15 may be placed prior to being secured onto the racquet handle 4. The grooves 17 on removable trigger insert 15, as well as the matching grooves 14 on indented portion 13, help prevent slippage of the removable trigger insert 15 and the trigger 16.

Any technique may be utilized to place an extension, such as extensions 5, 11, 16, and 19 onto a racquet handle 4. In FIGS. 1 and 2, the extensions 5 and 11 are shown basically as part of the racquet handles 4 and 9 and may be molded as part of those handles at the time of manufacture.

FIGS. 3 and 10 illustrate a type of replaceable trigger insert 15 which may be placed into an indented area which has been manufactured or retro-fitted into a racquet handle 4. The indented area within racquet handle 4 may be placed within it at the time of manufacture or may be cut within it at a later time in order to hold an insert, such as removable trigger insert 15. The indented area and the bottom of the replaceable trigger insert 15 may have matching grooves, or may be smooth, or may be of any surface or texture desired.

FIGS. 4, 5, 6, and 7 illustrate a wrap-around type trigger attachment 18 which may be placed over the racquet handle 4 after the wrapping 8 has been removed. The wrapping 8 may then be placed back onto the racquet handle 4 over the wrap-around trigger attachment 18 in order to secure the wrap-around trigger attachment 18 onto the racquet handle 4 with the trigger 19 protruding therefrom. This wrap-around trigger attachment 18 may be of any size or shape and may be secured in any manner desired. The securing method shown herein is the wrapping 8 placed over the wrap-around trigger attachment 18 securing the wrap-around trigger attachment 18 onto the racquet handle 4. Other securing means may be utilized to secure a wrap-around trigger attachment 18 or extension 18 to the racquet handle 4, as desired.

The trigger grip described herein may be built into the handle of a racquet at the time the handle is manufactured or may be built onto an insert which may be inserted into an indented area within the handle of a racquet. The trigger grip may also be built onto an attachment which wraps around a portion of the handle of a racquet and may be secured thereon. The trigger grip will extend outward from the handle of the racquet and has an inner surface on which a portion of the hand of a person may rest to increase the control of the racquet when the person is utilizing the racquet. When a person rests a portion of his hand on the inner surface of the trigger grip which is on the handle of a racquet, the possibility of slippage of the handle of the racquet is decreased and pressure on the grip will be absorbed, thereby saving wear and tear on the grip covering on the handle of the racquet. The invention may be utilized by either right or left handed players without changing the handle or the extension of the handle of the racquet.

The extension or trigger grip may be made of any material and of any shape. The extension may be flat or may be curved. One desirable extension shown is curved and rounded. The roundness may prevent blisters or roughness to the fingers of the user. The extension or trigger may be rough or smooth, as desired. If desired for gripping purposes, more than one extension or trigger may be utilized for gripping more than one finger. The attachment or trigger to the handle may be made in a manner so that the basic use of the racquet and the handle is not changed. The trigger may be placed onto the handle so that the grip utilized by the player is basically not changed. By having the trigger secured to the handle, friction is saved on the grip wrapping, thereby saving wear and tear on the grip wrapping around the handle allowing for a longer life span of the wrapping.

The extension or trigger may be constructed in a manner where it is wider in the intersection of the handle and the trigger and narrows slightly to a smaller cross-sectional area at the outer edge of the tip of the trigger. It may be a curved section so that the finger rests in the bottom of the curved area.

Utilizing the trigger attachment, the holder of the racquet handle has more control and a better feel for positioning the racquet in the hand. The player can tell whether or not the racquet is in the correct position utilizing the trigger as a reference point. In positioning the racquet for various shots, the player will know where the hand is on the racquet handle because of the knowledge of the location of the trigger. The player's hand will be on the racquet handle in the same place every time, therefore, giving a quality of consistency to the player's game. Utilizing the trigger, a firmer grip may be accomplished on the racquet handle giving more control and cutting down on vibration upon the striking of the ball. The use of the trigger will increase the accuracy of the player's shots.

The trigger has a base portion over which the grip wrapping 8 may be wrapped to secure the trigger onto the racquet handle. The base portion may be built into the racquet handle if the trigger is molded onto a new racquet handle or may be the base surface of an insert, such as removable trigger insert 15, or may be the entire wrap-around surface of an attachment, such as wrap-around trigger attachment 18. The trigger enables the player to have a better grip under adverse conditions, such as rain, and allows a better grip when the problems of perspiration become a factor. The trigger may be used on any racquet handle. The racquet handle may be curved or straight or of any shape or size desired. The handle may be used for a racquet game or any type game in which a handle is held in the hand or hands of a person and the handle has a striking area secured thereto.

While the invention has been described with reference to specific embodiments, the description is illustrative and is not to be construed as limiting the scope of the invention. Various modifications and changes may occur to those skilled in the art without departing from the spirit and scope of the invention as defined by the appended claims.

I claim:

1. A combination of a device and a handle secured to a striking area and utilized by a person comprising:

a. an indented portion in said handle;

b. a first plurality of grooves within said indented portion in said handle;

c. a base sized and shaped to fit within said indented portion in said handle, said base having a second plurality of grooves in the bottom portion of said base, whereby when said base is inserted into said indented portion in said handle, said first plurality of grooves will fit into said second plurality of grooves providing a slip-resistant contact between said base and said handle and the upper, outer edges of said base will meet the surrounding external portions of said handle producing a level surface;

d. a trigger extension, with a resting area for supporting a portion of the hand of said person utilizing said handle, secured to said base extending outward from said base away from said handle; and e. securing means securing said base to said handle and thereby securing the alignment of said trigger extension with respect to said handle, whereby said handle may be gripped securely utilizing said trigger extension in order to maximize the effectiveness of the movement of said handle to control the placement of said striking area.

2. A device according to claim 1 wherein said handle is straight.

3. A device according to claim 1 wherein said securing means is grip wrapping which is wrapped around said handle and over said base to secure said base to said handle and secure the alignment of said trigger extension with respect to said handle.

4. A device according to claim 1 wherein the surface of said trigger extension is smooth.

5. A device according to claim 4 wherein the resting area of said trigger extension has a gnarled surface.

* * * * *